US010943596B2

(12) United States Patent
Tsuji et al.

(10) Patent No.: US 10,943,596 B2
(45) Date of Patent: Mar. 9, 2021

(54) AUDIO PROCESSING DEVICE, IMAGE PROCESSING DEVICE, MICROPHONE ARRAY SYSTEM, AND AUDIO PROCESSING METHOD

(71) Applicant: PANASONIC INTELLECTUAL PROPERTY MANAGEMENT CO., LTD., Osaka (JP)

(72) Inventors: Hisashi Tsuji, Kanagawa (JP); Ryota Fujii, Fukuoka (JP); Hisahiro Tanaka, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 58 days.

(21) Appl. No.: 16/074,311

(22) PCT Filed: Feb. 8, 2017

(86) PCT No.: PCT/JP2017/004483
§ 371 (c)(1),
(2) Date: Jul. 31, 2018

(87) PCT Pub. No.: WO2017/150103
PCT Pub. Date: Sep. 8, 2017

(65) Prior Publication Data

US 2020/0152215 A1 May 14, 2020

(30) Foreign Application Priority Data

Feb. 29, 2016 (JP) ..... 2016-038227

(51) Int. Cl.
*G10L 21/003* (2013.01)
*G10L 21/013* (2013.01)
(Continued)

(52) U.S. Cl.
CPC ..... *G10L 21/013* (2013.01); *G10L 21/034* (2013.01); *G10L 25/63* (2013.01);
(Continued)

(58) Field of Classification Search
CPC ..... G10L 21/003
See application file for complete search history.

(56) References Cited

U.S. PATENT DOCUMENTS 5,641,926 A * 6/1997 Gibson ..... G10H 1/20 84/603
6,095,650 A * 8/2000 Gao ..... G02C 13/005
(Continued)

FOREIGN PATENT DOCUMENTS

EP 2819108 A1 12/2014
JP 2003-248837 A 9/2003
(Continued)

OTHER PUBLICATIONS

International Search Report, dated Apr. 11, 2017, by the Japan Patent Office (JPO) for International Application No. PCT/JP2017/004483.
(Continued)

*Primary Examiner* — Feng-Tzer Tzeng
(74) *Attorney, Agent, or Firm* — Greenblum & Bernstein, P.L.C.

(57) ABSTRACT

An audio processing device includes an acquisition unit that acquires audio that is picked up by a sound pick-up unit, a detector that detects an audio position of the audio, a determiner that determines whether or not the audio is a speech audio when the audio position is within a privacy protection area, an analyzer that analyzes the speech audio to acquire an emotion value, a converter that converts the speech audio into a substitute sound corresponding to the
(Continued)

emotion value, and an output controller that causes an audio output that outputs the audio to output the substitute sound.

7 Claims, 12 Drawing Sheets

(51) Int. Cl.
*G10L 21/034* (2013.01)
*G10L 25/63* (2013.01)
*H04R 3/00* (2006.01)
*H04R 5/04* (2006.01)

(52) U.S. Cl.
CPC ..... *H04R 3/005* (2013.01); *H04R 5/04* (2013.01); *G10L 21/003* (2013.01); *G10L 2021/0135* (2013.01)

(56) References Cited

U.S. PATENT DOCUMENTS 7,809,560 B2 * 10/2010 Yen ..... G10L 21/0272 381/94.2
2009/0138262 A1 * 5/2009 Agarwal ..... G06F 16/685 704/235
2010/0211397 A1 * 8/2010 Park ..... G06K 9/00268 704/276
2012/0287288 A1 * 11/2012 Steinberg ..... H04N 17/04 348/181
2014/0006017 A1 * 1/2014 Sen ..... H04S 7/30 704/208
2014/0376740 A1 12/2014 Shigenaga et al.
2017/0105662 A1 * 4/2017 Silawan ..... A61B 5/14542

FOREIGN PATENT DOCUMENTS

JP 2011-002704 A 1/2011
JP 2015-029241 A 2/2015

OTHER PUBLICATIONS

Extended European Search Report, dated Feb. 21, 2019, for the related European Patent Application No. 17759574.1.

* cited by examiner

FIG. 2A

47A

| CHANGE IN PITCH | EMOTION VALUE |
|---|---|
| LARGE | HIGH |
| MEDIUM | MEDIUM |
| SMALL | LOW |

FIG. 2B

47B

| SPEECH SPEED | EMOTION VALUE |
|---|---|
| FAST | HIGH |
| MEDIUM | MEDIUM |
| SLOW | LOW |

FIG. 2C

47C

| SOUND VOLUME | EMOTION VALUE |
|---|---|
| LARGE | HIGH |
| MEDIUM | MEDIUM |
| SMALL | LOW |

FIG. 2D

47D

| PRONUNCIATION (AUDIO RECOGNITION RATE) | EMOTION VALUE |
|---|---|
| BAD | HIGH |
| NORMAL | MEDIUM |
| GOOD | LOW |

FIG. 3

49

| EMOTION VALUE | BEEP SOUND (SINE WAVE) |
|---|---|
| HIGH | HIGH FREQUENCY (1 kHz) |
| MEDIUM | MEDIUM FREQUENCY (500 Hz) |
| LOW | LOW FREQUENCY (200 Hz) |

67

| EMOTION VALUE | FACE ICON |
|---|---|
| HIGH |  fm1 |
| MEDIUM |  fm2 |
| LOW |  fm3 |

AUDIO PROCESSING DEVICE, IMAGE PROCESSING DEVICE, MICROPHONE ARRAY SYSTEM, AND AUDIO PROCESSING METHOD

TECHNICAL FIELD

The present disclosure relates to an audio processing device, an image processing device, a microphone array system, and an audio processing method.

BACKGROUND ART

Recently, data recorded by using a camera and a microphone is being increasingly handled. The number of network camera systems installed at windows of stores and the like for the purpose of crime prevention and evidence tends to be increased. For example, in a case where a conversation between an employee and a customer at the window is recorded, sound recording and playback are needed to be performed in consideration of privacy protection of the customer. The same is true for video recording.

In the system, directivity with respect to audio that is picked up is formed in a direction oriented toward a designated audio position from a microphone array device. When the audio position is in a privacy protection area, the system controls the output of audio that is picked up (mute processing, masking processing or voice change processing), or pauses audio pick-up (see PTL 1).

It is an object of the present disclosure to sense a speaker's emotion while protecting privacy.

CITATION LIST

Patent Literature

PTL 1: Japanese Patent Unexamined Publication No. 2015-029241

SUMMARY OF THE INVENTION

An audio processing device according to the present disclosure includes an acquisition unit that acquires audio that is picked up by a sound pick-up unit, a detector that detects an audio position of the audio, a determiner that determines whether or not the audio is a speech audio when the audio position is within a privacy protection area, an analyzer that analyzes the speech audio to acquire an emotion value, a converter that converts the speech audio into a substitute sound corresponding to the emotion value, and an output controller that causes an audio output unit that outputs the audio to output the substitute sound.

According to the present disclosure, it is possible to sense the speaker's emotion while protecting privacy.

BRIEF DESCRIPTION OF DRAWINGS

FIG. 2A is a diagram showing registered contents of an emotion value table in which emotion values corresponding to changes in pitch are registered.

FIG. 2B is a diagram showing registered contents of an emotion value table in which emotion values corresponding to speech speeds are registered.

FIG. 2C is a diagram showing registered contents of an emotion value table in which emotion values corresponding to sound volumes are registered.

FIG. 2D is a diagram showing registered contents of an emotion value table in which emotion values corresponding to pronunciations are registered.

FIG. 3 is a diagram showing registered contents of a substitute sound table in which substitute sounds corresponding to emotion values are registered.

DESCRIPTION OF EMBODIMENTS

Hereinafter, exemplary embodiments will be described in detail with respect to drawings as appropriate. However, in some cases, details more than necessary will be omitted. For example, a detailed description of already well-known matters or a redundant description of substantially the same configuration will not be repeated. This is to avoid making the following description unnecessarily redundant, and to facilitate understanding of those skilled in the art. Furthermore, accompanying drawings and the following description are provided to enable those skilled in the art to fully understand the present disclosure, and are not intended to limit the claimed subject matter.

(Background Leading to One Exemplary Embodiment of Present Disclosure)

A recorded conversation between an employee and a customer is used in reviewing a trouble issue when a complaint occurs, and for in-company training material. When it is necessary to protect privacy in the conversation record, control of audio output of the conversation record is controlled, or the like is performed. For this reason, it is difficult to grasp what the customer said, and also difficult to understand what background there was. In addition, it is difficult to fathom a change in emotions of the customer facing the employee.

Hereinafter, an audio processing device, an image processing device, a microphone array system, and an audio processing method, which are capable of sensing a speaker's emotion while protecting privacy, will be described.

First Exemplary Embodiment

[Configurations]

Figure 1:
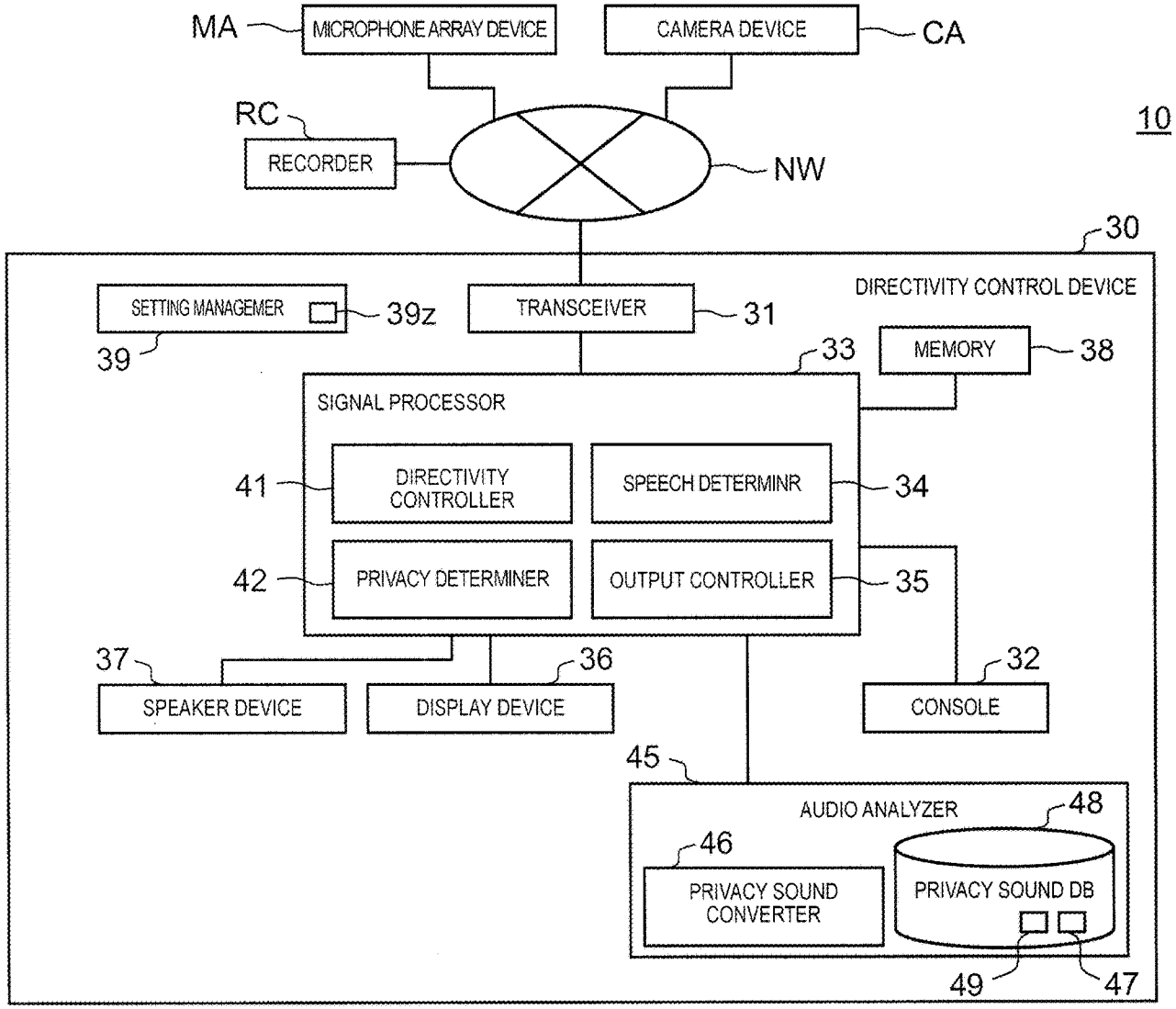
FIG. 1 is a block diagram showing a configuration of a microphone array system according to a first exemplary embodiment.

FIG. 1 is a block diagram showing a configuration of microphone array system 10 according to a first embodiment. Microphone array system 10 includes camera device CA, microphone array device MA, recorder RC, and directivity control device 30.

Camera device CA, microphone array device MA, recorder RC and directivity control device 30 are connected to each other so as to enable data communication through network NW. Network NW may be a wired network (for example, intranet and internet) or may be a wireless network (for example, Local Area Network (LAN)).

Camera device CA is, for example, a stationary camera that has a fixed angle of view and installed on a ceiling, a wall, and the like, of an indoor space. Camera device CA functions as a monitoring camera capable of imaging imaging area SA (see FIG. 5) that is the imaging space where the camera device CA is installed.

Camera device CA is not limited to the stationary camera, and may be an omnidirectional camera and a pan-tilt-zoom (PTZ) camera capable of panning, tilting and zooming operation freely. Camera device CA stores a time when a video image is imaged (imaging time) in association with image data, and transmits the data and time to directivity control device 30 through network NW.

Microphone array device MA is, for example, an omnidirectional microphone array device installed on the ceiling of the indoor space. Microphone array device MA picks up the omnidirectional audio in the pick-up space (audio pick-up area) in which microphone array device MA is installed.

Microphone array device MA includes a housing of which the center portion has an opening formed, and a plurality of microphone units concentrically arranged around the opening along the circumferential direction of the opening. As the microphone unit (hereinafter, simply referred to as a microphone), for example, a high-quality small electret condenser microphone (ECM) is used.

In addition, when camera device CA is an omnidirectional camera that is accommodated in the opening formed in the housing of microphone camera MA, for example, the imaging area and the audio pick-up area are substantially identical.

Microphone array device MA stores picked-up audio data in association with a time when the audio data is picked up, and transmits the stored audio data and the picked-up time to the directivity control device 30 via network NW.

Directivity control device 30 is installed, for example, outside the indoor space where microphone array device MA and camera CA are installed. The directivity control device 30 is, for example, a stationary personal computer (PC).

Directivity control device 30 forms the directivity with respect to the omnidirectional audio that is picked up by microphone array device MA, and emphasized the audio in the oriented direction. Directivity control device 30 estimates the position (also referred to as an audio position) of the sound source within the imaging area, and performs a predetermined mask processing when the estimated sound source is within a privacy protection area. The mask processing will be described later in detail.

Furthermore, directivity control device 30 may be a communication terminal such as a cellular phone, a tablet, a smartphone, or the like, instead of the PC.

Directivity control device 30 includes at least transceiver 31, console 32, signal processor 33, display device 36, speaker device 37, memory 38, setting manager 39, and audio analyzing unit 45. Signal processor 33 includes directivity controller 41, privacy determiner 42, speech determiner 34 and output controller 35.

Setting manager 39 converts, as an initial setting, coordinates of the privacy protection area designated by a user in the video image that is imaged by camera device CA and displayed on display device 36 into an angle indicating the direction oriented toward the audio area corresponding to the privacy protection area from microphone array device MA.

In the conversion processing, setting manager 39 calculates directional angles (θMAh, θMAv) oriented towards the audio area corresponding to the privacy protection area from microphone array device MA, in response to the designation of the privacy protection area. The details of the calculation processing are described, for example, in PTL 1.

θMAh denotes a horizontal angle in the direction oriented toward the audio position from microphone array device MA. θMAv denotes a vertical angle in the direction oriented toward the audio position from microphone array device MA. The audio position is the actual position corresponding to the position designated by the user's finger or a stylus pen in the video image data in which console 32 is displayed on display device 36. The conversion processing may be performed by signal processor 33.

In addition, setting manager 39 has memory 39*z*. Setting manager 39 stores coordinates of the privacy protection area designated by a user in the video image that is imaged by camera device CA and coordinates indicating the direction oriented toward the converted audio area corresponding to the privacy protection area in memory 39*z*.

Transceiver 31 receives video image data including the imaging time transmitted by the camera device and audio data including the picked-up time transmitted by microphone array device MA and outputs the received data to signal processor 33.

Console 32 is an user interface (UI) for notifying signal processor 33 of details of the user's input operation, and, for example, is configured to include a pointing device such as a mouse, a keyboard, and the like. Further, console 32 may be disposed, for example, corresponding to a screen of display device 36, and configured using a touch screen or a touch pad permitting input operation by the user's finger and a stylus pen.

User designates privacy protection area PRA that is an area which the user wishes to be protected for privacy in the video image data of camera device CA displayed on display device 36 (see FIG. 5) by using console 32. Then, console 32 acquires coordinate data representing the designated position of the privacy protection area and outputs the data to signal processor 33.

Memory 38 is configured, for example, using a random access memory (RAM), and functions as a program memory, a data memory, and a work memory when directivity control device 30 operates. Memory 38 stores audio data of the audio that is picked up by microphone array device MA together with the picked-up time.

Signal processor 33 includes speech determiner 34, directivity controller 41, privacy determiner 42 and output controller 35, as a functional configuration. Signal processor 33 is configured, for example, using a central processing unit (CPU), a micro processing unit (MPU), or digital signal processor (DSP), as hardware. Signal processor 33 performs control processing of totally overseeing operations of each unit of directivity control device 30, input/output processing of data with other units, calculation (computation) processing of data, and storing processing of data.

Speech determiner 34 analyzes the audio that is picked up to recognize whether or not the audio is speech. Here, the audio may be a sound having a frequency within the audible frequency band (for example, 20 Hz to 23 kHz), and may include sounds other than audio uttered by a person. In addition, speech is the audio uttered by a person, and is a sound having a frequency in a narrower frequency band (for example, 300 Hz to 4 kHz) than the audible frequency band. For example, using the voice activity detector (VAD), which implements the technology that detects a section in which audio is produced from the input sound, the speech is recognized.

Privacy determiner 42 determines whether or not the audio that is picked up by microphone array device MA is detected within the privacy protection area by using audio data stored in memory 38.

When the audio is picked up by microphone array device MA, privacy determiner 42 determines whether or not the direction of the sound source is within the range of the privacy protection area. In this case, for example, privacy determiner 42 divides the imaging area into a plurality of blocks, forms directivity of audio for each block, determines whether or not there is audio that exceeds a threshold value of the oriented direction of the audio, and estimates an audio position in the imaging area.

As a method of estimating an audio position, a known method may be used; for example, a method described in the paper, "Multiple sound source location estimation based on CSP method using microphone array", Takanobu Nishiura et al., Transactions of the Institute of Electronics, Information and Communication Engineers, D-11 Vol. J83-D-11 No. 8 pp. 1713-1721 August 2000, may be used.

Privacy determiner 42 may form directivity with respect to the audio that is picked up by microphone array device MA at a position in the privacy protection area, and determine whether the audio is detected in the oriented direction of the audio. In this case, it is possible to determine whether the audio position is within the range of the privacy protection area. However, although the audio position is outside the privacy protection area, the position is not specified.

Output controller 35 controls operations of camera device CA, microphone array device MA, display device 36 and speaker device 37. Output controller 35 causes display device 36 to output video image data transmitted from camera device CA, and causes speaker device 37 to output audio data transmitted from microphone array device MA as sound.

Directivity controller 41 performs the formation of directivity using audio data that is picked up and transmitted to directivity control device 30 by microphone array device MA. Here, directivity controller 41 forms directivity in the direction indicated by directional angle θMAh and θMAv calculated by setting manager 39.

Privacy determiner 42 may determine whether the audio position is included in privacy protection area PRA (see FIG. 5) designated in advance based on coordinate data indicating the calculated oriented direction.

When determination is made that the audio position included in privacy protection area PRA, output controller 35 controls the audio that is picked up by microphone array device MA, for example, outputs a substitute sound by substituting the substitute sound for the audio and reproducing the substitute sound. The substitute sound includes, for example, what is called a "beep sound", as one example of a privacy sound.

In addition, output controller 35 may calculate sound pressure of the audio in privacy protection area PRA, which is picked up by microphone array device MA, and output the substitute sound when a value of the calculated audio pressure exceeds a sound pressure threshold value.

When the substitute sound is output, output controller 35 transmits the audio in privacy protection area PRA which is picked up by microphone array device MA to audio analyzer 45. Output controller 35 acquires audio data of the substitute data from audio analyzer 45, based on the result of audio analysis performed by audio analyzer 45.

Upon receiving the audio in privacy protection area PRA that is picked up by microphone array device MA, audio analyzer 45 analyzes the audio to acquire an emotion value with regard to the emotion of a person who utters the audio. In the audio analysis, audio analyzer 45 acquires emotion values such as a high and sharp tone, a falling tone, a rising tone, or the like, for example, by analyzing a change in pitch (frequency) of the speech audio that the speaker utters from the audio in privacy protection area PRA. As the emotion value, the emotion value is divided, for example, into three stages, "high", "medium", and "low". The emotion value may be divided into any number of stages.

In privacy protection sound database (DB) 48 of audio analyzer 45, four emotion value tables 47A, 47B, 47C and 47D are held (see FIG. 2A to 2D). In particular, when there is no need to distinguish the tables from each other, they are collectively referred to as emotion value table 47. Emotion value table 47 is stored in privacy sound DB 48.

FIG. 2A is a schematic diagram showing registered contents of emotion value table 47A in which emotion values corresponding to changes in pitch are registered.

In emotion value table 47A, for example, when the change in pitch is "large", the emotion value is set to be "high", as a high and sharp tone, or the like. For example, when the change in pitch is "medium", the emotion value is set to be "medium", as a slightly rising tone, or the like. For example, when the change in pitch is "small", the emotion value is set to be "low", as a falling and calm tone, or the like.

FIG. 2B is a schematic diagram showing registered contents of emotion value table 47B in which emotion values corresponding to speech speeds are registered. The speech speed is represented by, for example, the number of words uttered by the speaker within a predetermined time.

In emotion value table 47B, for example, when the speech speed is fast, the emotion value is set to be "high", as an increasingly fast tone, or the like. For example, when the speech speed is normal (medium), the emotion value is set to be "medium", as a slightly fast tone, or the like. For example, when the speech speed is slow, the emotion value is set to be "low", as a calm mood.

FIG. 2C is a schematic diagram showing registered contents of emotion value table 47C in which emotion values corresponding to sound volumes are registered.

In emotion value table 47C, for example, when the volume of the audio that the speaker utters is large, the emotion value is set to be "high", as a lifted mood. For example, when the volume is normal (medium), the emotion value is set to be "medium", as a normal mood. For example, when the volume is small, the emotion value is set to be "small", as a calm mood.

FIG. 2D is a schematic diagram showing registered contents of emotion value table 47D in which emotion values corresponding to pronunciations are registered.

Whether pronunciation is good or bad is determined, for example, based on whether the recognition rate through audio recognition is high or low. In emotion value table 47D, for example, when the audio recognition rate is low and the pronunciation is bad, the emotion value is set to be "large", as angry. For example, when the audio recognition rate is medium and the pronunciation is normal (medium), the emotion value is set to be "medium", as calm. For example, when the audio recognition rate is high and the pronunciation is good, the emotion value is set to be "small", as cold-hearted.

Audio analyzer 45 may use any emotion table 47, or may derive the emotion values using a plurality of emotion value tables 47. Here, as one example, audio analyzer 45 acquires the emotion values from the change in pitch in the emotion value table 47A.

Audio analyzer 45 includes privacy sound converter 46 and privacy sound DB 48.

Privacy sound conversion 46 converts the speech audio in privacy protection area PRA into a substitute sound corresponding to the emotion value.

In privacy sound DB 48, one piece of audio data of a sinusoidal wave (sine wave) representing a beep sound is registered as a privacy sound, for example. Privacy sound conversion 46 reads out the sinusoidal audio data registered in privacy sound DB 48, and outputs sinusoidal audio data of a frequency corresponding to the emotion value based on the audio data that is read during a period in which speech audio is output.

For example, privacy sound converter 46 outputs a beep sound of 1 kHz when the emotion value is "high", a beep sound of 500 Hz when the emotion value is "medium", and a beep sound of 200 Hz when the emotion value is "low". Incidentally, the above mentioned frequencies are merely examples, and other height may be set.

In addition, privacy sound converter 46 may register audio data corresponding to emotion values, for example, in privacy sound DB 48 in advance, and read out the audio data, instead of generating audio data of a plurality of frequencies based on one sinusoidal audio data.

FIG. 3 is a schematic diagram showing registered contents of substitute sound table 49 in which substitute sounds corresponding to emotion values are registered. Substitute sound table 49 is stored in privacy sound DB 48.

In substitute sound table 49, as substitute sounds corresponding to the emotion values, privacy sounds of three frequencies described above are registered. Furthermore, without being limited to these, in privacy sound DB 48, various sound data may be registered, such as data of a canon sound representing a state of being angry when the emotion value is "high", data of a slingshot sound representing a state of not being angry when the emotion value is "medium", and data of a melody sound representing a state of being joyful when the emotion value is "low".

Display device 36 displays video image data that is imaged by camera device CA on a screen.

Speaker device 37 outputs, as audio, audio data that is picked up by microphone array device MA, or audio data that is picked up by microphone array device MA of which directivity is formed at directional angle θMAN and θMAv. Display device 36 and speaker device 37 may be separate devices independent of directivity control device 30.

Figure 4:
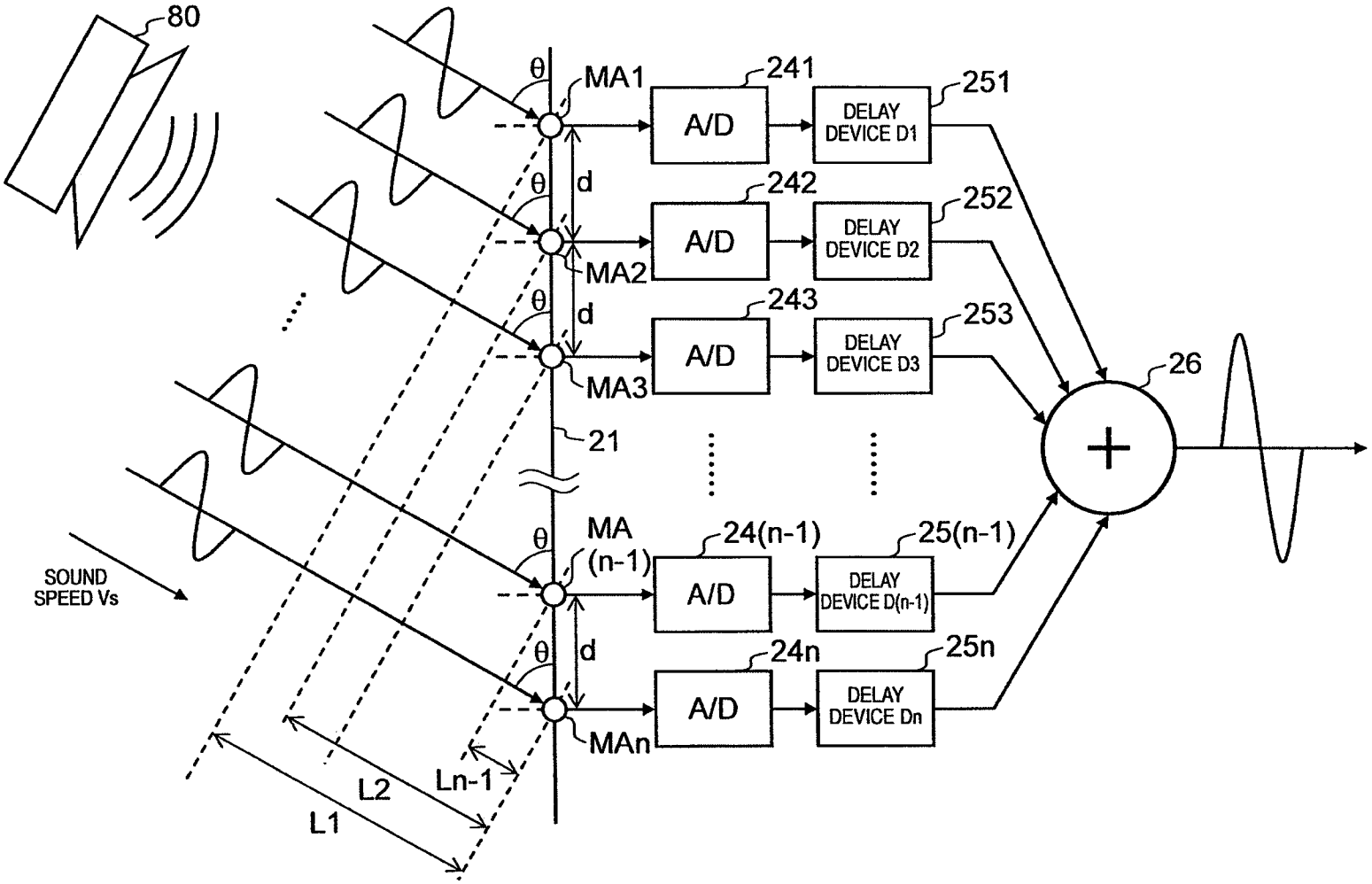
FIG. 4 is a diagram describing one example of a principle of forming directivity with respect to audio that is picked up by a microphone array device in a predetermined direction.

FIG. 4 is a diagram describing one example of a principle of forming directivity with respect to sound that is picked up by microphone array MA in a predetermined direction.

Directivity control device 30 performs a direction control processing using the audio data that is transmitted from microphone array device MA, thereby adding each piece of audio data that is picked up by each of microphones MA1 to MAn. Directivity control device 30 generates audio data of which directivity is formed in a specific direction so as to emphasize (amplify) audio (volume level) in a specific direction from the position of each of microphones MA1 to MAn of microphone array device MA. The "specific direction" is a direction from microphone array device MA to the audio position designated by console 32.

A technique related with directivity control processing of audio data for forming directivity of audio that is pickup up by microphone array device MA is the known technique, as is disclosed in, for example, Japanese Unexamined Patent Application Publication No. 2014-143678 and Japanese Unexamined Patent Application Publication No. 2015-029241 (PTL 1).

In FIG. 4, for ease of description, microphones MA1 to MAn are one-dimensionally arranged in a line. In this case, directivity is set in a two-dimensional space in a plane. Furthermore, in order to form directivity in a three-dimensional space, microphones MA1 to MAn may be two-dimensionally arranged and be subjected to similar processing.

Sound waves that originated from sound source 80 enter each of microphones MA1, MA2, MA3, . . . , MA(n−1), MAn that are built in microphone array device MA at a certain constant angle (incident angle=(90−(degree)). Incident angle θ may be composed of a horizontal angle θMAh and a vertical angle θMAv in the direction oriented toward the audio position from microphone array device MA.

Sound source 80 is, for example, a speech of a person who is a subject of camera device CA that lies in a sound pick-up direction microphone array device MA picks up the audio. Sound source 80 is present in a direction at a predetermined angle θ with respect to a surface of housing 21 of microphone array device MA. In addition, distance d between respective microphones MA1, MA2, MA3, . . . , MA(n−1), MAn is set to be constant.

The sound waves that originated from sound source 80, for example, first arrive at microphone MA1 and are picked up, then arrive at microphone MA2 and are picked up, and do the same one after the other. Lastly, the sound waves finally arrive at microphone MAn and picked up.

In microphone array device MA, A/D converters 241, 242, 243, . . . , 24(*n*−1), 24*n* convert analog audio data, which is picked up by each of microphones MA1, MA2, MA3, . . . , MA(n−1), MAn, into digital audio data.

Furthermore, in microphone array device MA, delay devices 251, 252, 253, . . . , 25(*n*−1), 25*n* provide delay times corresponding to time differences that occur because the sound waves each arrive at microphones MAL MA2, MA3, . . . , MA(n−1), MAn at a different time, and have phases of all the sound waves aligned, and then an adder 26 adds pieces of sound data after the delay processing.

As a result, microphone array device MA forms directivity of audio data in a direction of the predetermined angle θ in each of microphones MA1, MA2, MA3, . . . , MA(n−1), MAn.

As a result, microphone array device MA changes delay times D1, D2, D3, . . . , Dn−1, Dn that are established in delay devices 251, 252, 253, . . . , 25($n$−1), 25$n$, thereby making it possible to easily form directivity of audio data that is picked up.

[Operations]

Next, operations of microphone array system 10 will be described. Here, a case where a conversation between a customer visiting a store and a receptionist is picked up and output is shown as an example.

Figure 5:
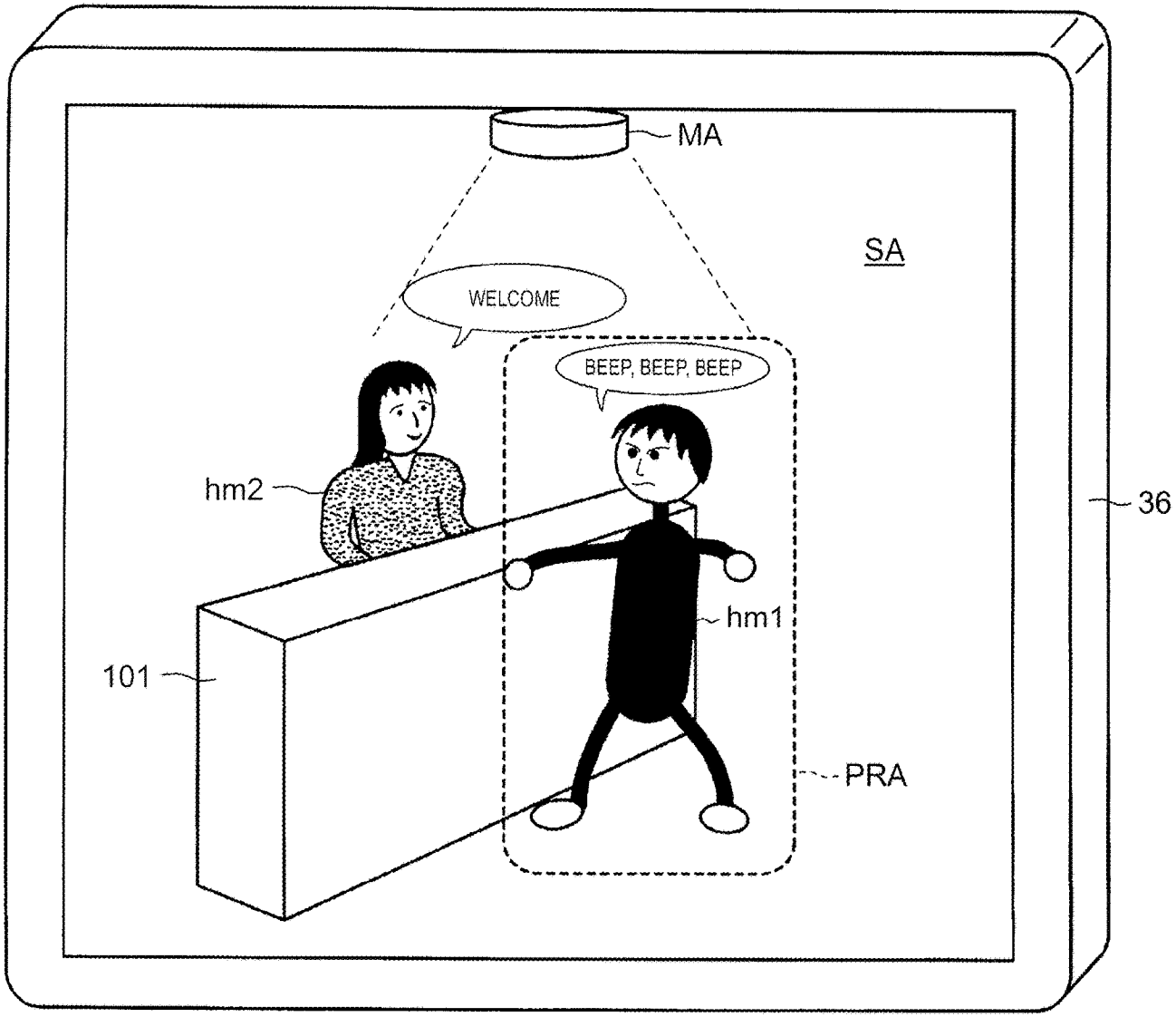
FIG. 5 is a diagram showing a video image representing a situation where a conversation between a receptionist and a customer is picked up by the microphone array device installed at a window of a store.

FIG. 5 is a schematic diagram showing a video image representing a situation where a conversation between receptionist hm2 and customer hm1 is picked up by microphone array device MA installed at a window of a store.

In the image of FIG. 5, imaging area SA imaged by camera device CA that is a stationary camera installed on the ceiling inside the store is displayed on display device 36. For example, microphone array device MA is installed immediately above counter 101 where receptionist hm2 (one example of an employee) meets customer hm1 face-to face. Microphone array device MA picks up audio in the store, including the conversation between receptionist hm2 and customer hm1.

Counter 101 where customer hm1 is located is set to privacy protection area PRA. Privacy protection area PRA is set by a user designating a range on a video image displayed on display device 36 beforehand by a touch operation or the like, for example.

In the video image of FIG. 5, the situation is shown in imaging area SA, where customer hm1 visits the store and enters the privacy protection area PRA installed in front of counter 101. For example, when receptionist hm2 greets and says, "Welcome", the audio is output from speaker device 37. Furthermore, for example, when customer hm1 speaks with an angry expression, the audio is output from speaker device 37 by being replaced with a privacy sound, "beep, beep, beep."

Accordingly, confidentiality of what is said is secured. Further, the user of microphone array system 10 can sense the emotion of customer hm1 from the change in pitch, or the like of the privacy protection sound outputted from speaker device 37.

In addition, speech bubbles expressing speeches that are uttered by receptionist hm2 and customer hm1 are added so as to make the description easier to recognize.

Figure 6:
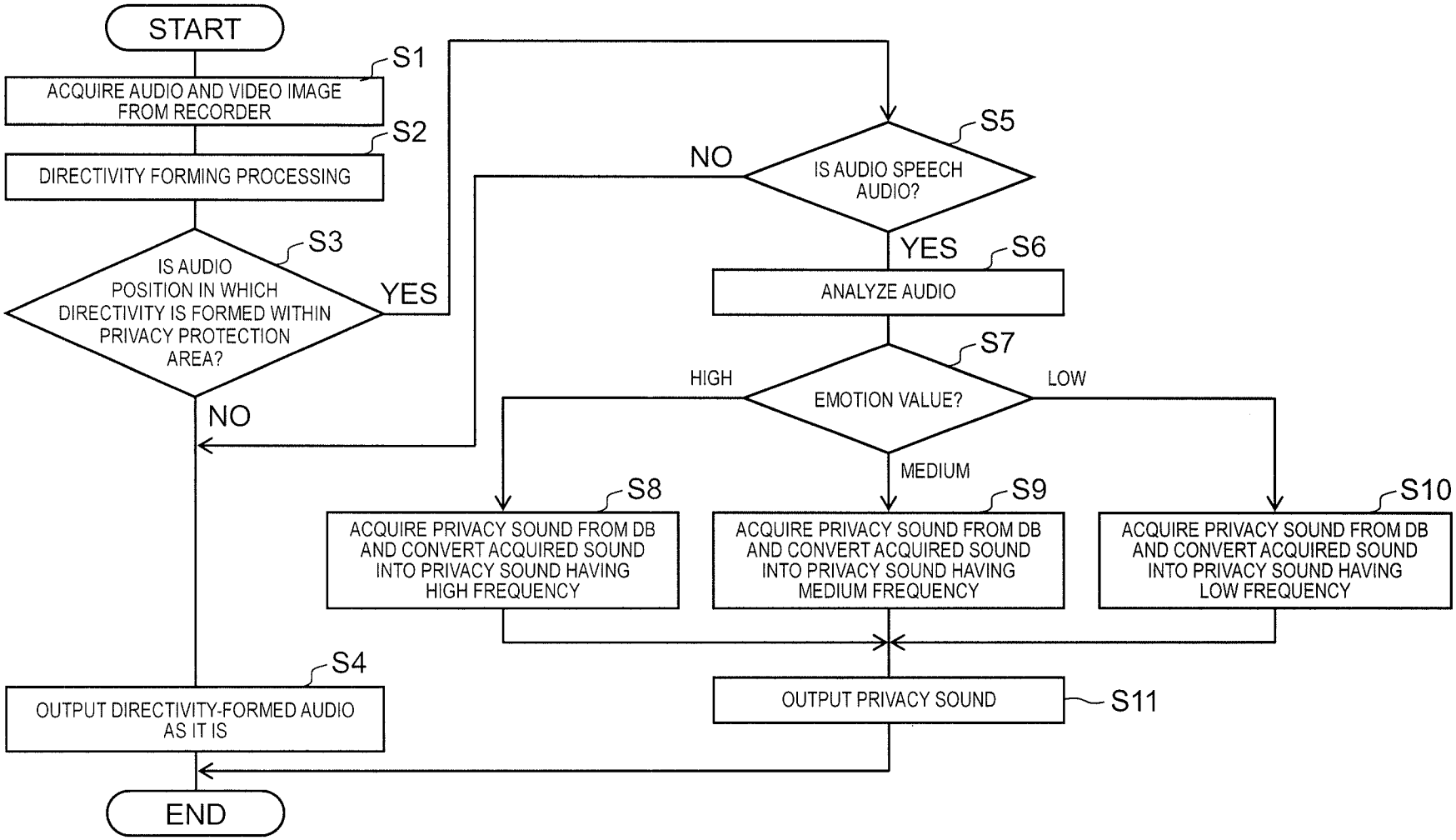
FIG. 6 is a flowchart showing a procedure of outputting audio that is picked up by the microphone array device.

FIG. 6 is a flowchart showing a procedure of outputting audio that is picked up by microphone array device NIA. The audio output operation is performed, for example, after audio data of audio that is picked up by microphone array device MA is temporarily stored in recorder RC.

Transceiver 31 acquires audio data and video image data of a predetermined time which are stored in recorder RC through network NW (S1).

Directivity controller 41 forms directivity with regard to audio data that is picked up by microphone array device MA, and acquires audio data in which a predetermined direction, such as within a store, is set to be the oriented direction (S2).

Privacy determiner 42 determines whether or not an audio position at which directivity is formed by directivity controller 41 is within privacy protection area PRA (S3).

When the audio position is not within the privacy protection area PRA, output controller 35 outputs the audio data with directivity formed, as it is, to speaker device 37 (S4). In this case, output controller 35 outputs video image data to display device 36. Then, signal processor 33 ends the operation.

In S3, when the audio position at which directivity is formed by directivity controller 41 is within privacy protection area PRA, speech determiner 34 determines whether or not audio with directivity formed is the speech audio (S5).

In S5, for example, speech determiner 34 determines whether audio with directivity formed is audio spoken by people, such as the conversation between receptionist hm2 and customer hm1, and a sound that has a frequency in a narrower band (for example, 300 Hz to 4 kHz) than the audible frequency band.

Although the speech audio is the subject of audio analysis here, all audio produced in privacy protection area PRA may be subjected to the audio analysis.

In S5, when audio with directivity formed is not speech audio, signal processor 33 proceeds to the processing of S4 described above.

In S5, when audio with directivity formed is the speech audio, audio analyzer 45 performs audio analysis on audio data with directivity formed (S6).

According to the result of audio analysis, audio analyzer 45 uses the emotion value table 47 registered in privacy sound DB 48 to determine whether the emotion value of the speech audio is "high", "medium", or "low" (S7).

In S7, when the emotion value of the speech audio is "high", privacy sound converter 46 reads out a sinusoidal audio data using substitute sound data 49, and converts the read audio data into audio data of a high frequency (for example, 1 kHz) (S8).

Output controller 35 outputs audio data of the high frequency to speaker device 37 as a privacy sound (S11). Speaker device 37 outputs a "beep sound" that corresponds to the privacy sound. Then, signal processor 33 ends the operation.

In S7, when the emotion value of the speech audio is "medium", privacy sound converter 46 reads out a sinusoidal audio data using substitute sound data 49, and converts the read audio data into audio data of a medium frequency (for example, 500 Hz) (S9).

In S11, output controller 35 outputs audio data of the medium frequency to speaker device 37 as a privacy sound. Speaker device 37 outputs a "beep sound" that corresponds to the privacy sound. Then, signal processor 33 ends the operation.

In S7, when the emotion value of the speech audio is "low", privacy sound converter 46 reads out a sinusoidal audio data using substitute sound data 49, and converts the read audio data into audio data of a low frequency (for example, 200 Hz) (S10).

In S11, output controller 35 outputs audio data of the low frequency to speaker device 37 as a privacy sound. Speaker device 37 outputs a "beep sound" that corresponds to the privacy sound. Then, signal processor 33 ends the operation.

In microphone array system 10, for example, even though the user does not recognize customer hm1's speech that is output from speaker device 37, the user can sense the emotion of customer hm1, such as anger, from the pitch of the beep sound that is produced as the privacy sound.

Therefore, for example, even though the recorded conversation between receptionist hm2 and customer hm1 is used in reviewing a trouble issue, and for in-company training material, the user can understand the change in emotion of customer hm1 in a state of keeping the content of customer hm1's speech concealed.

[Effects]

As described above, the audio processing device includes an acquisition unit that acquires audio that is picked up by a sound pick-up unit, a detector that detects an audio position of the audio, a determiner that determines whether or not the audio is a speech audio when the audio position is within a privacy protection area PRA, an analyzer that acquires the speech audio to acquire an emotion value, a converter that converts the speech audio into a substitute sound corresponding to the emotion value, and an output controller 35 that causes an audio output unit that outputs the audio to output the substitute sound.

The audio processing device is, for example, the directivity control device 30. The sound pick-up unit is, for example, microphone array device MA. The acquisition unit is, for example, transceiver 31. The detector is, for example, directivity controller 41. The determiner is, for example, speech determiner 34. The analyzer is, for example, audio analyzer 45. The audio output unit is, for example, speaker device 37. The converter is, for example, privacy sound converter 46. The substitute sound is, for example, the privacy sound.

Accordingly, the audio processing device can grasp the emotion of the speaker while protecting privacy. For example, the speech audio can be concealed, and privacy protection of customer hm1 is guaranteed. Furthermore, rather than masking spoken audio without any distinction, the audio processing device uses substitute sounds that are distinguishable according to the spoken audio, thereby making it possible to output the substitute sound according to the emotion of a speaker. Moreover, even if the recorded conversation between receptionist hm2 and customer hm1 is used in reviewing a trouble issue when a complaint occurs, and for in-company training material, the user can estimate the change in the emotion of customer hm1. That is, for example, when a complaint occurs, the user can find out how employee hm2 has to respond to customer hm1 so that the customer hm1 calms down.

In addition, the analyzer may analyze at least one (including a plurality of combinations) of the change in pitch, the speech speed, the volume and the pronunciation with respect to the speech audio to acquire the emotion value.

Accordingly, the audio processing device can perform audio analysis on the speech audio in various ways. Therefore, the user can appropriately grasp the emotion of customer hm1.

In addition, converter may change the frequency of the substitute sound according to the emotion value.

Thus, the audio processing device can output the privacy sounds of different frequencies according to the emotion value. Therefore, the user can appropriately grasp the emotion of customer hm1.

Second Exemplary Embodiment

In the first exemplary embodiment, the substitute sound corresponding to the emotion value obtained by performing the audio analysis by audio analyzer 45 is output as the privacy sound. In a second exemplary embodiment, a face icon corresponding to an emotion value is output instead of the image of the audio position imaged by camera device CA.

[Configurations]

Figure 7:
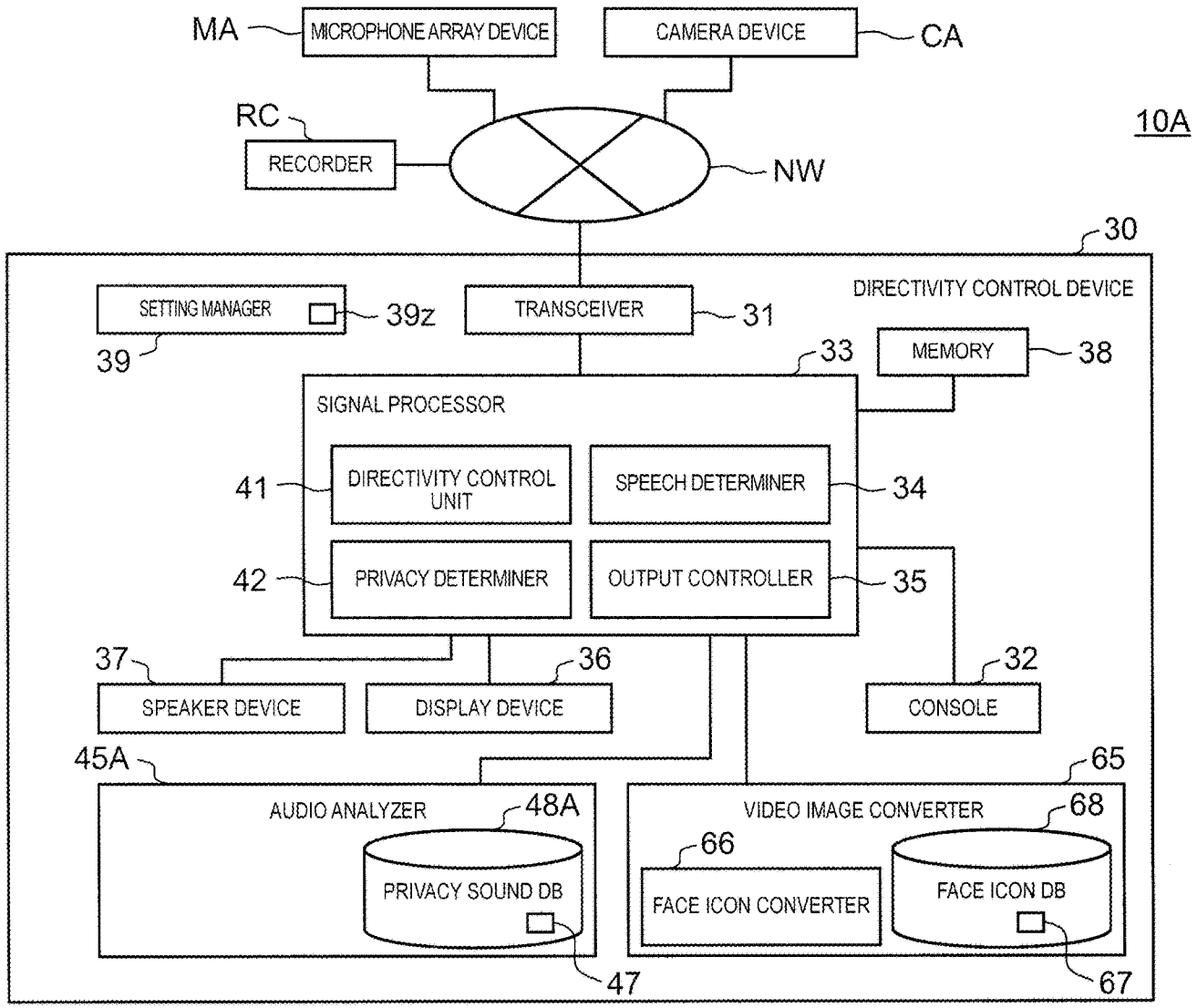
FIG. 7 is a block diagram showing a configuration of a microphone array system according to a second exemplary embodiment.

FIG. 7 is a block diagram showing a configuration of microphone array system 10A according to the second exemplary embodiment. The microphone array system of the second exemplary embodiment includes substantially the same configuration as that of the first exemplary embodiment. Regarding the same constituent elements as those of the first exemplary embodiment, the same reference marks are used, and thus the description thereof will be simplified or will not be repeated.

Microphone array system 10A includes audio analyzer 45A and video image converter 65 in addition to the same configuration as microphone array system 10 according to first exemplary embodiment.

Audio analyzer 45A includes privacy sound DB 48A excluding privacy sound converter 46. Upon receiving the audio in privacy protection area PRA that is picked up by microphone array device MA, audio analyzer 45A analyzes the audio to acquire an emotion value with regard to the emotion of a person who utters the audio. The audio analysis uses emotion value table 47 registered in privacy sound DB 48A.

Video image converter 65 includes face icon converter 66 and face icon DB 68. Video image converter 65 converts the image of the audio position imaged by camera device CA into a substitute image (such as face icon) corresponding to the emotion value. Substitute image table 67 is stored in face icon DB 68.

Figure 8:
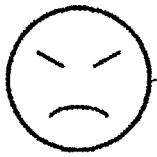
FIG. 8 is a diagram showing registered contents of a substitute image table.
Figure 8:
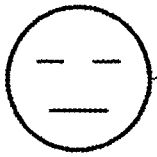
Figure 8:
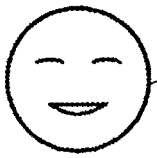

FIG. 8 is a schematic diagram showing registered contents of substitute image table 67.

Emotion values corresponding to face icons fm (fm1, fm2, fm3, . . . ) are registered in substitute image table 67. For example, in a case of "high" that the emotion value is high, the face icon is converted into face icon fm1 with an angry facial expression. For example, in a case of "medium" that the emotion value is normal (medium), the face icon is converted into face icon fm2 with a gentle facial expression. For example, in a case of "low" that the emotion value is low, the face icon is converted into face icon fm3 with a smiling facial expression.

In FIG. 8, although three registration examples are shown, any number of the face icons may be registered so as to correspond to the emotion values.

Face icon converter 66 acquires face icon fm corresponding to an emotion value obtained by performing an audio analysis by audio analyzer 45A, from substitute image table 67 in face icon DB 68. Face icon converter 66 superimposes acquired face icon fm on the image of the audio position imaged by camera device CA. Video image converter 65 transmits image data obtained after converting the face icon to output controller 35. Output controller 35 causes display device 36 to display the image data obtained after converting the face icon.

[Operations]

Next, operation of microphone array system 10A will be described. Here, as an example, a case where a conversation between a customer who visits a store and a receptionist of the store is picked up to output audio is shown.

Figure 9:
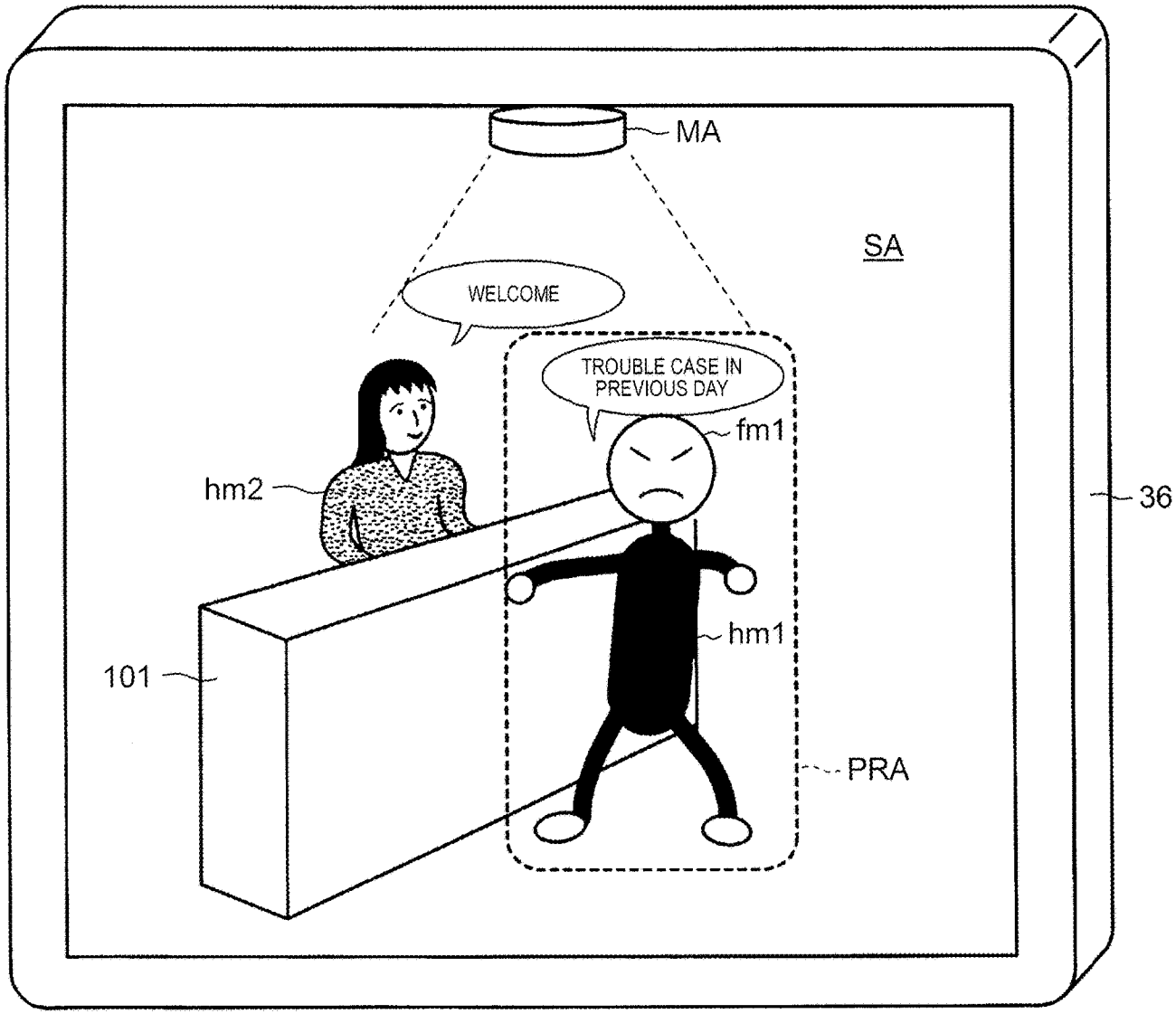
FIG. 9 is a diagram showing a video image representing a situation where a conversation between a receptionist and a customer is picked up by the microphone array device installed at a window of a store.

FIG. 9 is a schematic diagram showing a video image representing a situation where a conversation between receptionist hm2 and customer hm1 is picked up by microphone array device MA installed at a window of a store.

In the video image of FIG. 9, imaging area SA imaged by camera device CA which is a stationary camera installed on a ceiling inside the store is displayed on display device 36. For example, microphone array device MA is installed directly above counter 101 where receptionist hm2 meets customer hm1 face-to-face. Microphone array device MA picks up audio in the store, including the conversation between receptionist hm2 and customer hm1.

Counter 101 where customer hm1 is located is set to privacy protection area PRA. Privacy protection area PRA is set by a user designating a range on a video image displayed on display device 36 beforehand by a touch operation or the like, for example.

In the video image of FIG. 9, the situation is shown in imaging area SA, where customer hm1 visits the store and enters the privacy protection area PRA installed in front of counter 101. For example, when receptionist hm2 greets and says, "Welcome", the audio is output from speaker device 37. In addition, for example, audio that customer hm1 uttered is output as "the trouble issue in the previous day" from speaker device 37. What the customer said can be recognized.

On the other hand, face icon fm1 with an angry facial expression is drawn around the face of customer hm1 (audio position), which stands in privacy protection area PRA.

Accordingly, the user can sense what customer hm1 said, and sense customer hm1's emotion from face icon fm1. On the other hand, customer hm1's face is concealed (masked) by face icon fm1, privacy protection of customer hm1 is guaranteed.

In addition, speech bubbles expressing speeches that are uttered by receptionist hm2 and customer hm1 are added so as to make the description easier to recognize.

Figure 10:
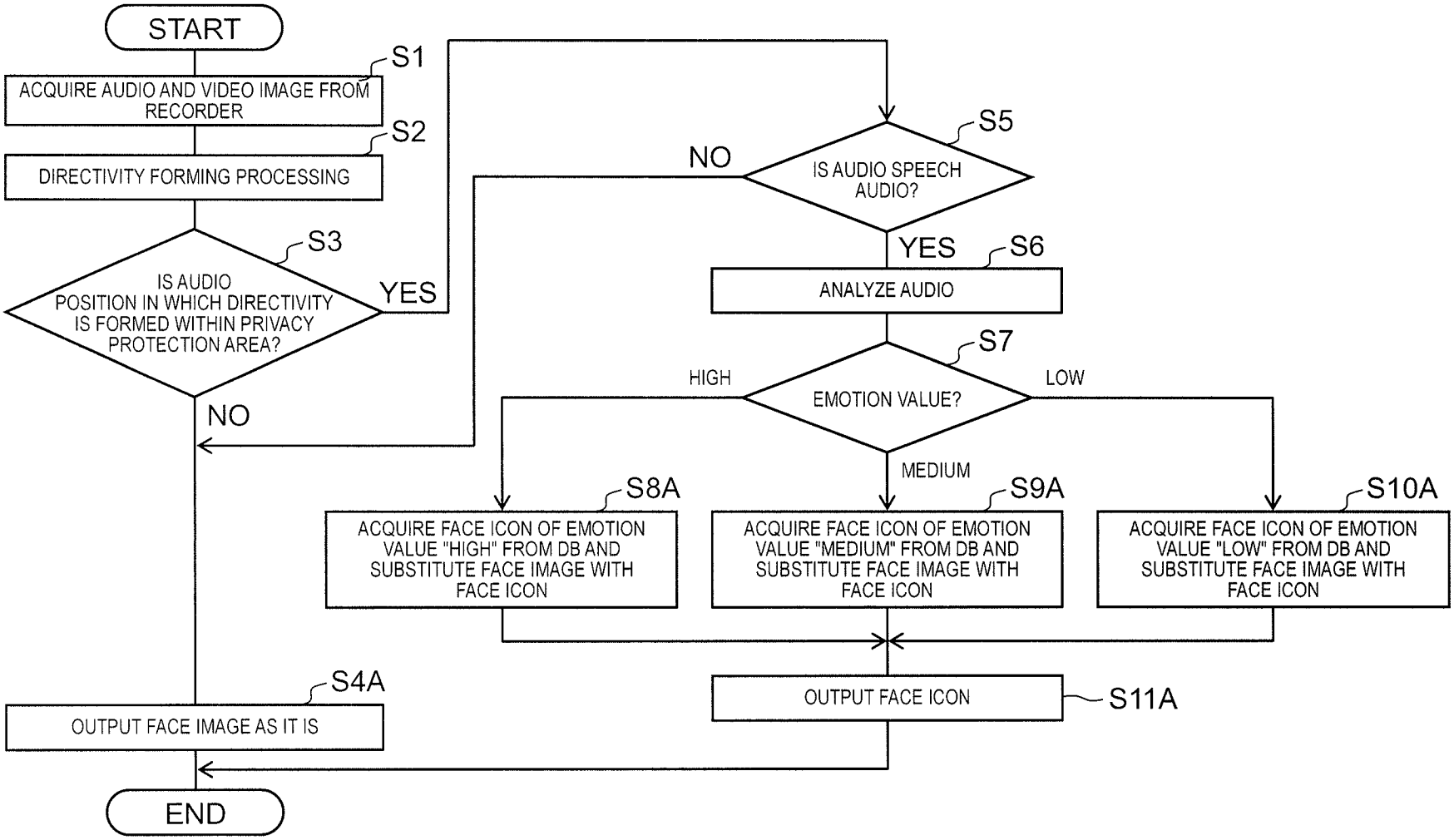
FIG. 10 is a flowchart showing a procedure of outputting a video image including a face icon based on audio that is picked up by the microphone array device.

FIG. 10 is a flowchart showing a procedure of outputting a video image including a face icon based on audio that is picked up by microphone array device MA. The video image output operation is performed after image data and audio data of audio which is picked up by microphone array device MA are temporarily stored in recorder RC.

Furthermore, in processing of the same steps as those of the first exemplary embodiment, the same step numbers are applied, and thus the description will be omitted or simplified.

In S3, when the audio position is not in privacy protection area PRA, output controller 35 outputs video image data including a face image, which is imaged by camera device CA to display device 36 (S4A). In this case, output controller 35 outputs audio data with directivity formed, as it is, to speaker device 37. Then, signal processor 33 ends the operation.

In S7, when an emotion value of the speech audio is "high", face icon converter 66 reads face icon fm1 corresponding to the emotion value of "high", which is registered in substitute image table 67. Face icon converter 66 superimposes read face icon fm1 on the face image (audio position) of the video image data imaged by camera device CA to convert the video image data (S8A).

In addition, face icon converter 66 may replace the face image (audio position) of the video image data imaged by camera device CA with read face icon fm1 to convert the video image data (S8A).

Output controller 35 outputs the converted video image data to display device 36 (S11A). Display device 36 displays the video image data including face icon fm1. In this case, output controller 35 outputs audio data with directivity formed, as it is, to speaker device 37. Then, signal processor 33 ends the operation.

In S7, when an emotion value of the speech audio is "medium", face icon converter 66 reads face icon fm2 corresponding to the emotion value of "medium", which is registered in substitute image table 67. Face icon converter 66 superimposes read face icon fm2 on the face image (audio position) of the video image data imaged by camera device CA to convert the video image data (S9A).

In addition, face icon converter 66 may replace the face image (audio position) of the video image data imaged by camera device CA with read face icon fm2 to convert the image data (S9A).

In S11A, output controller 35 outputs the converted video image data to display device 36. Display device 36 displays the video image data including face icon fm2. In this case, output controller 35 outputs audio data with directivity formed, as it is, to speaker device 37. Then, signal processor 33 ends the operation.

In S7, when an emotion value of the speech audio is "low", face icon converter 66 reads face icon fm3 corresponding to the emotion value of "low", which is registered in substitute image table 67. Face icon converter 66 superimposes read face icon fm3 on the face image (audio position) of the video image data imaged by camera device CA to convert the image data (S10A).

In addition, face icon converter 66 may replace the face image (audio position) of the video image data imaged by camera device CA with read face icon fm3 to convert the image data (S10A).

In S11A, output controller 35 outputs the converted video image data to display device 36. Display device 36 displays the video image data including face icon fm3. In this case, output controller 35 outputs directivity-formed audio data, as it is, to speaker device 37. Then, signal processor 33 ends the operation.

In microphone array system 10A, for example, even though it is difficult to visually recognize a face image of customer hm1 displayed on display device 36, the user can sense an emotion, such as customer hm1 being angry based on the type of displayed face icons fm.

Therefore, for example, even though a recorded conversation between receptionist hm2 and customer hm1 is used in reviewing a trouble issue and for in-company training material, the user can understand a change in emotions of customer hm1 in a state where the face image of customer hm1 is concealed.

[Effects]

As described above, in the audio processing device, the acquisition unit acquires the video image of imaging area SA imaged by the imaging unit and audio of imaging area SA picked up by the sound pick-up unit. The converter converts the video image of audio position into the substitute image corresponding to the emotion value. Output controller 35 causes display unit that displays the video image to display the substitute image.

The imaging unit is camera device CA or the like. The converter is face icon converter 66 or the like. The substitute image is face icon fm or the like. The display unit is display device 36 or the like.

The image processing device according to the present exemplary embodiment includes an acquisition unit that acquires a video image of imaging area SA imaged by an imaging unit, and audio of imaging area SA picked up by a sound pick-up unit, a detector that detects an audio position of the audio, a determiner that determines whether or not the audio is a speech audio when the audio position is within privacy protection area PRA, an analyzer that analyzes the speech audio to acquire an emotion value, a converter that converts an image of the audio position into a substitute image corresponding to the emotion value, and output controller 35 that causes a display unit that displays the image to display the substitute image. In addition, the image processing device is directivity control device 30 or the like.

Accordingly, the user can sense customer hm1's emotion from face icon fm. Customer hm1's face can be concealed (masked) by face icons, privacy protection of customer hm1 is guaranteed. As a result, the audio processing device can visually grasp the emotion of the speaker while protecting privacy.

Furthermore, the converter may cause the substitute image representing different emotions to be displayed, according to the emotion value.

Accordingly, the audio processing device can output face icon fm or the like representing different facial expressions according to the emotion value. Therefore, the user can appropriately grasp the emotion of customer hm1.

Third Exemplary Embodiment

A third exemplary embodiment shows a case that the processing of converting the audio into the privacy sound according to the first exemplary embodiment and the processing of converting the emotion value into the face icon according to the second exemplary embodiment are combined with each other.

Figure 11:
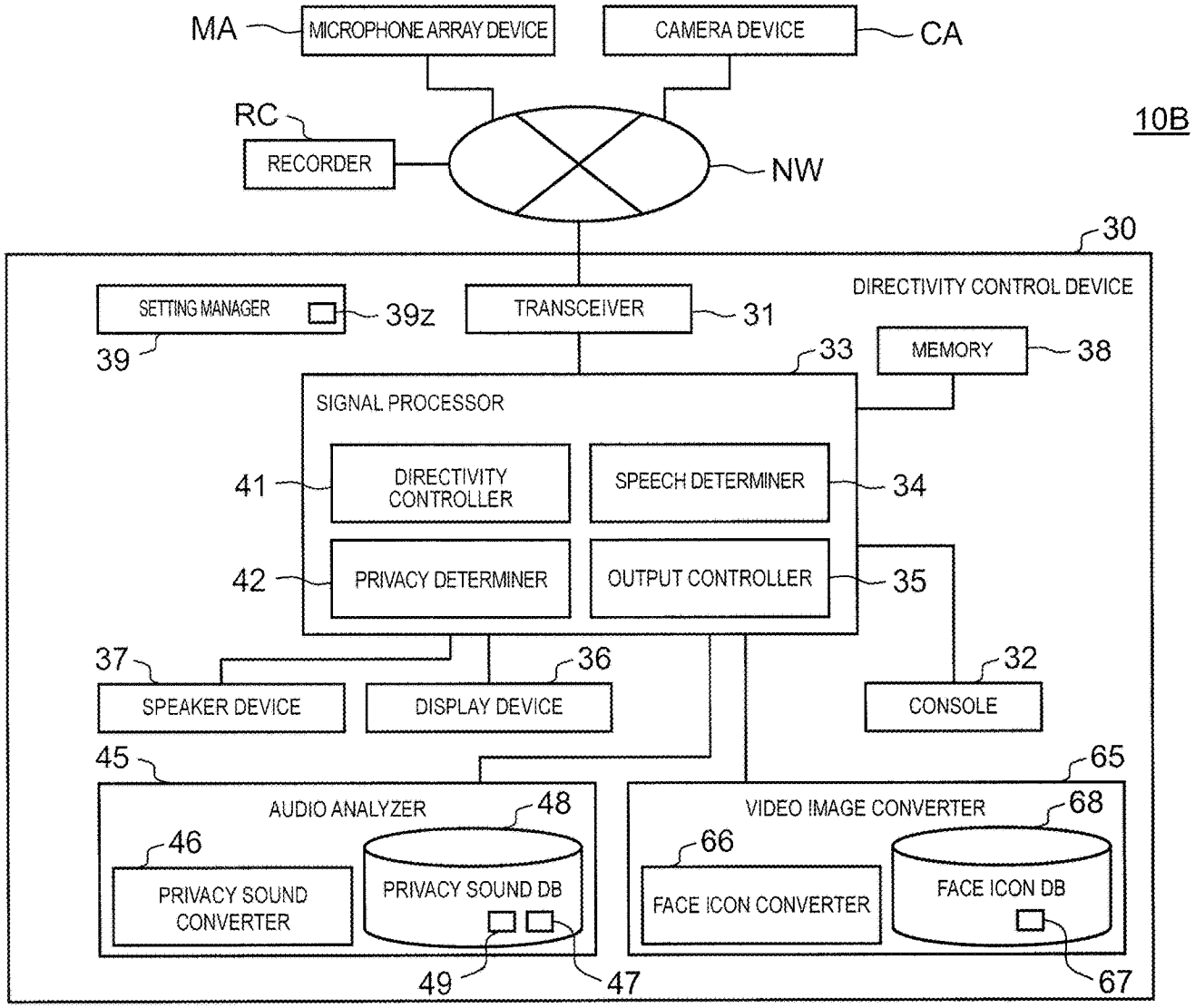
FIG. 11 is a block diagram showing a configuration of a microphone array system according to a third exemplary embodiment.

FIG. 11 is a block diagram showing a configuration of microphone array system 10B according to the third exemplary embodiment. Regarding the same constituent, elements as those of the first and second exemplary embodiments, the same reference marks are used, and thus the description will be omitted or simplified.

Microphone array system 10B includes a similar configuration as those of the first and second exemplary embodiments, and both audio analyzer 45 and video image converter 65. Configurations and operations of audio analyzer 45 and video image converter 65 are as described above.

Similarly to the first exemplary embodiment and the second exemplary embodiment, for example, microphone array system 10B assumes a case that a conversation between a customer who visits a store and a receptionist of the store is picked up to output audio, and an imaging area where the customer and the receptionist are located is recorded.

Figure 12:
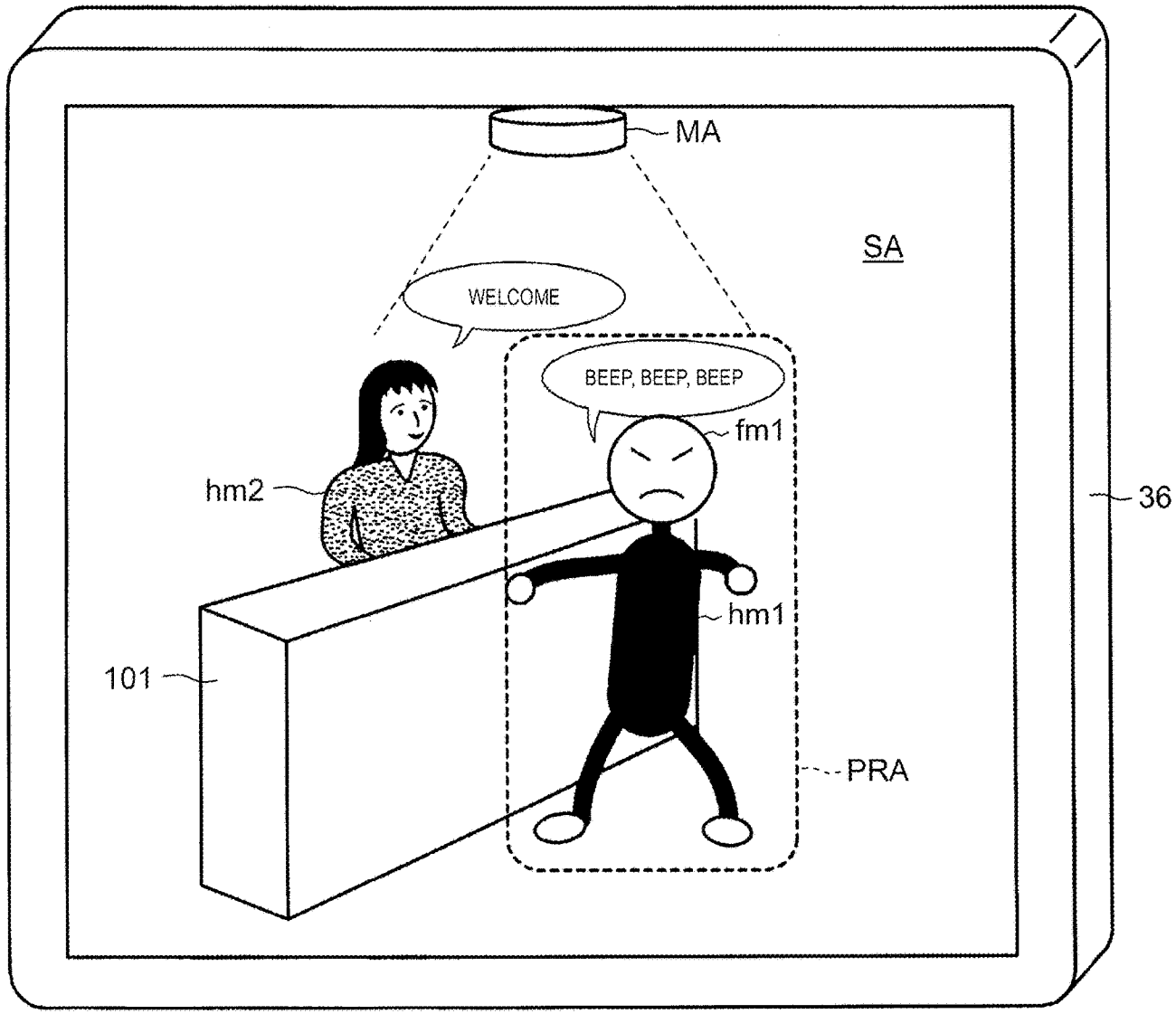
FIG. 12 is a diagram showing a video image representing a situation where a conversation between a receptionist and a customer is picked up by the microphone array device installed at a window of a store.

FIG. 12 is a schematic diagram showing a video image representing a situation where a conversation between employee hm2 and customer hm1 is picked up by microphone array device MA installed at a window of a store.

In the video image displayed on display device 36 illustrated in FIG. 12, the situation in which customer hm1 visits the store, and customer hm1 enters privacy protection area PRA installed in front of counter 101 is shown. For example, when receptionist hm2 greets and says "welcome", the audio is output from speaker device 37. In addition, customer hm1 speaks to receptionist hm2 but a privacy sound of "beep, beep, beep" is output from speaker device 37.

Accordingly, confidentiality of what is said is secured. Furthermore, the user of microphone array system 10B can sense customer hm1's emotion from changes in pitch of the privacy sound output from speaker device 37.

In the video image of FIG. 12, face icon fm1 with an angry facial expression is disposed around the face of customer hm1 (audio position), which stands in privacy protection area PRA.

Accordingly, the user can sense customer hm1's emotion from face icon fm1. Customer hm1's face is concealed (masked) by face icon fm1, privacy protection of customer hm1 is guaranteed.

[Effects]

As described above, microphone array system 10B includes an imaging unit that images an video image of imaging area SA, a sound pick-up unit that picks up audio of the imaging area, a detector that detects an audio position of the audio that is picked up by the sound pick-up unit, a determiner that determines whether or not the audio is a speech audio when the audio position is within privacy protection area PRA, an analyzer that analyzes the speech audio to acquire an emotion value, a converter that performs a conversion processing corresponding to the emotion value, and output controller 35 that outputs a result of the conversion processing. For example, the conversion processing includes at least one of the audio processing of converting the audio into the privacy sound or image conversion processing of converting the emotion value into face icon fm.

Accordingly, since what customer hm1 says is concealed by the privacy sound and customer hm1's face is concealed by face icon fm, microphone array system 10B can further protect the privacy. At least one of concealing what customer hm1 says or concealing customer hm1's face is executed. In addition, the user more easily senses customer hm1's emotion according to the change in pitch of the privacy sound or the type of face icons.

Other Exemplary Embodiments

As such, the first to third exemplary embodiments have been described as examples of the technology in the present disclosure. However, the technology in the present disclosure is not limited thereto, and can be also applied to other exemplary embodiments to which modification, replacement, addition, omission, or the like is made. Furthermore, the respective exemplary embodiments may be combined with each other.

In the first and third exemplary embodiments, when the audio position of the audio detected by microphone array device MA is within privacy protection area PRA, the processing of converting the audio detected in imaging area SA into the privacy sound is performed without depending on the user. Instead, the processing of converting the audio into the privacy sound may be performed depending on the user. In addition to the processing of converting the audio into the privacy sound, it also applies to the processing of converting the emotion value into the face icon.

For example, when the user that operates directivity control device 30 is a general user, the processing of converting the audio into the privacy sound may be performed, and when the user is an authorized user such as an administrator, the processing of converting the audio into the privacy sound may not be performed. Which user it is, for example, it may be determined by a user ID or the like used when the user logs on directivity control device 30.

In first and third exemplary embodiments, privacy sound converter 46 may perform voice change processing (machining processing) on audio data of audio that is picked up by microphone array device MA, as the privacy sound corresponding to the emotion value.

As an example of voice change processing, privacy sound converter 46 may change a high/low frequency (pitch) of audio data of audio picked up by microphone array device MA. That is, privacy sound converter 46 may change a frequency of audio output from speaker device 37 to another frequency such that the content of the audio is difficult to be recognized.

Accordingly, the user can sense a speaker's emotion while making it difficult to recognize the content of the audio within privacy protection area PRA. In addition, it is not necessary to store a plurality of privacy sounds on privacy sound DB 48 in advance.

As described above, output controller 35 may cause speaker device 37 to output the audio that is picked up by microphone array device MA and is processed. Accordingly, the privacy of a subject (for example, person) present within privacy protection area PRA can be effectively protected.

In the first to third exemplary embodiments, output controller 35 may explicitly notify the user, on the screen, that the audio position corresponding to the position designated on the screen by the user's finger or a stylus pen is included in privacy protection area PRA.

In the first to third exemplary embodiments, at least some of the audio or the video image according to the emotion value are converted into another audio, video image, or image to be substituted (substitute output or result of conversion processing) when the sound source position or the direction of the sound source position is the range or the direction of the privacy protection area. Instead, privacy determiner 42 may determine whether or not the picked-up time period is included in a time period during which privacy protection is needed (privacy protection time). When the picked-up time is included in the privacy protection time, privacy sound converter 46 or face icon converter 66 may convert at least some of audio or a video image, according to the emotion value.

In the exemplary embodiments of the present disclosure, customer hm1 is set to be in privacy protection area PRA, and at least some of the audio or the video image is converted into another audio, a video image or an image to be substituted, according to the emotion value detected from the speech of customer hm1. However, receptionist hm2 may be set to be in privacy protection area and at least some of audio or an image may be converted into another audio, a video image, or an image to be substituted, according to an emotion value detected from the speech of receptionist hm2. Accordingly, for example, when used in reviewing a trouble issue when a complaint occurs, and for in-company training material, an effect of making it difficult to identify an employee by changing the face of the receptionist to an icon can be expected.

Furthermore, in the exemplary embodiments of the present disclosure, the conversation between customer hm1 and receptionist hm2 is picked up by using microphone array device MA and directivity control device 30. However, instead of pick up the conversation, speech of each of customer hm1 and receptionist hm2 may be picked up using a plurality of microphones (such as a directivity microphone) installed in each of the vicinity of customer hm1 and in the vicinity of receptionist hm2.

INDUSTRIAL APPLICABILITY

The present disclosure is useful for an audio processing device, an image processing device, a microphone array system and an audio processing method capable of sensing emotions of a speaker while protecting privacy.

REFERENCE MARKS IN THE DRAWINGS

10, 10A, 10B MICROPHONE ARRAY SYSTEM
21 HOUSING
26 ADDER
30 DIRECTIVITY CONTROL DEVICE
31 TRANSCEIVER
32 CONSOLE
33 SIGNAL PROCESSOR
34 SPEECH DETERMINER
35 OUTPUT CONTROLLER
36 DISPLAY DEVICE
37 SPEAKER DEVICE
38 MEMORY
39 SETTING MANAGER
39*z* MEMORY
41 DIRECTIVITY CONTROLLER
42 PRIVACY DETERMINER
45, 45A AUDIO ANALYZER
46 PRIVACY SOUND CONVERTER
47, 47A, 47B, 47C, 47D EMOTION VALUE TABLE
48, 48A PRIVACY SOUND DATABASE (DB)
49 SUBSTITUTE SOUND TABLE
65 VIDEO IMAGE CONVERTER
66 FACE ICON CONVERTER
67 SUBSTITUTE IMAGE TABLE
68 FACE ICON DATABASE (DB)
80 SOUND SOURCE
101 COUNTER
241, 242, 243, . . . , 24*n* A/D CONVERTER
251, 252, 253, . . . , 25*n* DELAY DEVICE
CA CAMERA DEVICE
fm, fm1, fm2, fm3 FACE ICON
hm1 CUSTOMER
hm2 RECEPTIONIST
NW NETWORK
MA MICROPHONE ARRAY DEVICE
MA1, MA2, . . . , MAn, MB1, MB2, . . . , MBn MICROPHONE
RC RECORDER
SA IMAGING AREA

The invention claimed is:

1. An audio privacy processing device, comprising:

a microphone array device that acquires audio from a person in a designated audio pick-up area;

a signal processor that receives the acquired audio over a network, and determines when an audio position of the person is within a privacy protection area in the designated audio pick-up area;

an audio analyzer that analyzes speech audio of the person in the privacy protection area and determines an emotion of the person based on the analyzed speech audio by accessing a privacy protection sound database that includes emotion value tables, and that converts the determined emotion of the person into a designated substitute sound having a designated frequency from a plurality of predetermined substitute sounds and predetermined designated frequencies; and an output controller that outputs the designated substitute sound and designated frequency from a speaker in place of the speech audio of the person while the person is in the privacy protection area, wherein the designated substitute sound is a beep sound, and wherein the microphone array device is an omnidirectional microphone array device installed on a ceiling of an indoor space.

2. The audio privacy processing device of claim 1, wherein the audio analyzer analyzes at least one of a change in pitch, a speech speed, a sound volume, and a pronunciation of the speech audio to determine the emotion of the person.

3. The audio privacy processing device of claim 1, wherein the microphone array device includes a housing of which a center portion has an opening with a plurality of microphones concentrically arranged around the opening along a circumferential direction of the opening.

4. The audio privacy processing device of claim 1, further comprising:

an electronic setting manager that stores designated coordinates of the privacy protection area in a memory.

5. The audio privacy processing device of claim 1, wherein the predetermined designated frequency of the beep sound relates to an audio frequency in Hz or Khz.

6. The audio privacy processing device of claim 1, wherein the predetermined designated frequency of the beep sound relates to a timing interval between beep sounds.

7. A video image privacy processing device, comprising:

a video camera device that acquires video images and audio of a person in a designated video image and audio pick-up area;

a signal processor that receives the acquired video images and audio over a network, and determines when an video image position and audio of the person is within a privacy protection area in the designated video image pick-up area;

an electronic setting manager that stores designated coordinates of the privacy protection area in the video images in a memory;

an audio analyzer that analyzes speech audio of the person in the privacy protection area and determines an emotion of the person based on the analyzed speech audio by accessing a privacy protection sound database that includes emotion value tables;

a video image converter that converts the determined emotion of the person into a designated substitute face icon having a designated facial expression from a plurality of predetermined substitute face icons having predetermined designated facial expressions; and an output controller that superimposes the designated substitute face icon having the designated facial expression on a face of the person to hide the face of the person in the acquired video images while the person is in the privacy protection area.

* * * * *